US009146529B2

(12) United States Patent
Hashimoto

(10) Patent No.: US 9,146,529 B2
(45) Date of Patent: Sep. 29, 2015

(54) UNIT PROVIDED WITH GUIDE MEMBER CAPABLE OF RELIABLY GUIDING RECORDING MEDIUM

(71) Applicant: Brother Kogyo Kabushiki Kaisha, Nagoya-shi, Aichi-ken (JP)

(72) Inventor: Junichi Hashimoto, Toyohashi (JP)

(73) Assignee: Brother Kgyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/297,758

(22) Filed: Jun. 6, 2014

(65) Prior Publication Data

US 2014/0363197 A1 Dec. 11, 2014

(30) Foreign Application Priority Data

Jun. 7, 2013 (JP) ..... 2013-120657

(51) Int. Cl.
*G03G 21/16* (2006.01)

(52) U.S. Cl.
CPC ..... *G03G 21/1647* (2013.01); *G03G 21/1633* (2013.01); *G03G 2221/1684* (2013.01)

(58) Field of Classification Search
CPC ..... G03G 21/18; G03G 21/1676; G03G 21/1874; G03G 21/1619
USPC ..... 399/111
See application file for complete search history.

(56) References Cited

U.S. PATENT DOCUMENTS

| | | | | |
|---|---|---|---|---|
| 7,506,866 | B2 | 3/2009 | Igarashi | |
| 7,862,030 | B2 | 1/2011 | Igarashi | |
| 2006/0002735 | A1 | 1/2006 | Tamaru et al. | |
| 2006/0067732 | A1 | 3/2006 | Igarashi | |
| 2006/0079358 | A1 | 4/2006 | Igarashi | |
| 2006/0180973 | A1 | 8/2006 | Igarashi | |
| 2008/0226343 | A1 * | 9/2008 | Jeon et al. | 399/122 |
| 2009/0152791 | A1 | 6/2009 | Igarashi | |
| 2010/0135692 | A1 * | 6/2010 | Abe et al. | 399/111 |

FOREIGN PATENT DOCUMENTS

| | | |
|---|---|---|
| JP | 2006-096527 A | 4/2006 |
| JP | 2009-020450 A | 1/2009 |

OTHER PUBLICATIONS

Machine translation of Aoi, JP 2009-020450A, publication date: Jan. 29, 2009.*

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

A unit for an image forming apparatus includes: a frame; a photosensitive drum; and a guide member. The frame includes: first and second side plates spaced apart from each other in a first direction and a bridging member. The guide member bridges the first and second side plates; and guides a recording medium in a second direction. The guide member includes: first and second positioned portions fixed in position relative to the first and second side plates; and a supported portion supported to the bridging member. A downstream end of the guide member in the second direction and one of the first and second positioned portions define a first distance therebetween, and the downstream end and the supported portion define a second distance therebetween as viewed in the first direction. The first distance is smaller than the second distance.

12 Claims, 10 Drawing Sheets

UNIT PROVIDED WITH GUIDE MEMBER CAPABLE OF RELIABLY GUIDING RECORDING MEDIUM

CROSS REFERENCE TO RELATED APPLICATION

This application claims priority from Japanese Patent Application No. 2013-120657 filed Jun. 7, 2013. The entire content of the priority application is incorporated herein by reference.

TECHNICAL FIELD

The present invention relates to a unit mountable in an image forming apparatus employing an electrophotographic system.

BACKGROUND

There is conventionally known an electrophotographic image forming apparatus including an image carrying member that carries a developer image on its surface, and a transfer member that transfers the developer image from the image carrying member to a recording medium such as a sheet of paper.

One such image forming apparatus is a color laser printer that specifically includes a drum unit having four photosensitive drums corresponding to four colors, and four transfer rollers corresponding to the four photosensitive drums.

The drum unit of this color laser printer is also provided with a guide unit for guiding sheets of paper conveyed from a sheet supply tray, and a pressing member for pressing against the sheets as the sheets are supplied between the photosensitive drums and the corresponding transfer rollers.

SUMMARY

However, since the drum unit of this conventional color laser printer is provided with not only the guide unit, but also the pressing member, for guiding the sheets of paper between the photosensitive drums and the corresponding transfer rollers, the drum unit has a complex construction.

In order to simplify the structure of the drum unit, one could consider modifying the conventional color laser printer described above by eliminating the pressing member and providing only the guide unit on the drum unit, for example.

However, the guide unit is integrally formed with a front beam of the drum unit. Consequently, if the dimensions of the front beam fluctuate due to manufacturing variation, linear expansion, or the like, the guide unit may not be able to guide the sheets of paper between the photosensitive drums and the transfer rollers with sufficient precision.

In view of the foregoing, it is an object of the present invention to provide a unit having a simple construction and that is capable of guiding a recording medium reliably In order to attain the above and other objects, the present invention provides a unit for an image forming apparatus that may include: a frame; a photosensitive drum; and a guide member. The frame may include: a first side plate; a second side plate disposed spaced apart from the first side plate in a first direction; and a bridging member bridging the first side plate and the second side plate. The photosensitive drum may be supported to the first side plate and the second side plate.

The guide member may bridge the first side plate and the second side plate and may be configured to guide a recording medium in a second direction perpendicular to the first direction. The guide member may have a downstream end in the second direction. The guide member may include: a first positioned portion configured to be fixed in position relative to the first side plate; a second positioned portion configured to be fixed in position relative to the second side plate; and a supported portion configured to be supported to the bridging member. The downstream end and one of the first positioned portion and the second positioned portion may define a first distance therebetween as viewed in the first direction. The downstream end and the supported portion may define a second distance therebetween as viewed in the first direction. The first distance is smaller than the second distance.

DETAILED DESCRIPTION

Figure 1:
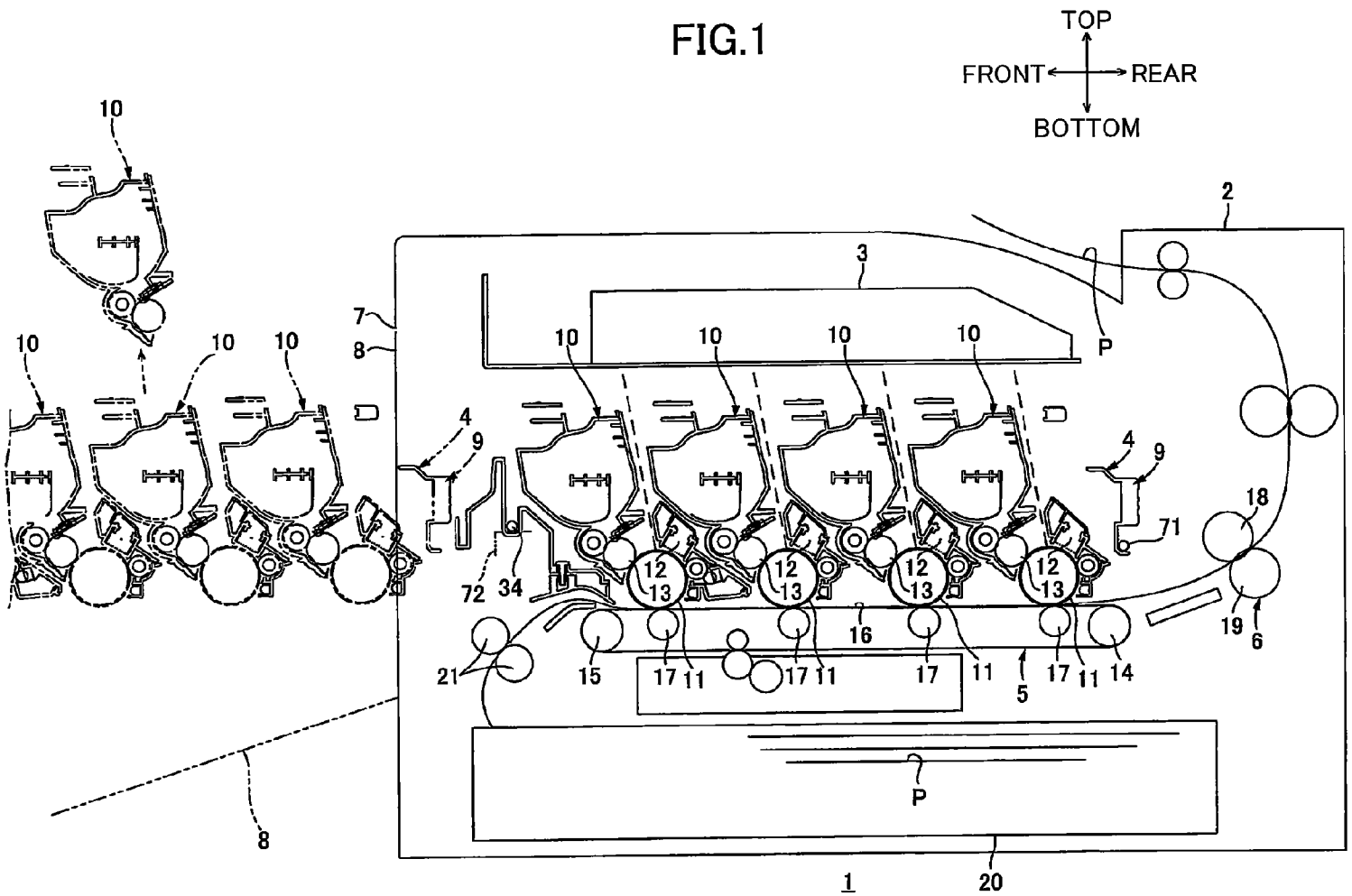
FIG. 1 is a central cross-sectional view of a printer provided with a drawer unit according to one embodiment of the present invention.

A printer provided with a drawer unit as a unit according to one embodiment of the present invention will be described with reference to FIGS. 1 through 9, wherein like parts and components are designated by the same reference numerals to avoid duplicating description.

1. Overall Structure of Printer

The printer 1 shown in FIG. 1 is a horizontal tandem type direct transfer color laser printer.

Directions in the following description related to the printer 1 will assume that the printer 1 is placed on a level surface and in an orientation in which it is intended to be used. Hence, the upper side of the printer 1 in FIG. 1 will be referred to as the "top," and the lower side thereof will be referred to as the "bottom." Further, the left side of the printer 1 in FIG. 1 will be referred to as the "front," and the right side thereof will be referred to as the "rear." Left and right sides of the printer 1 will be based on the perspective of a user facing the front of the printer 1. Therefore, the near side of the printer 1 in FIG. 1 will be referred to as the "right side," and the far side thereof will be referred to as the "left side." The left-right direction is an example of a first direction, and the front-rear direction in FIG. 1 is an example of a second direction. Further, the use of "forward" is an example of "upstream in the second direction," while "rearward" is an example of "downstream in the second direction."

The printer 1 includes a main casing 2 as an example of a main casing of an image forming apparatus, a sheet supply tray 20, a scanning unit 3, a process unit 4, a transfer unit 5, and a fixing unit 6.

The main casing 2 has a generally box-like shape. The main casing 2 includes an opening 7, a front cover 8, and a pair of conveying rollers 21.

The opening 7 is formed in a front wall of the main casing 2, penetrating the front wall of the main casing 2 in a front-rear direction.

The front cover 8 is supported on the front wall of the main casing 2. The front cover 8 is pivotally movable about its lower edge in order to expose or cover the opening 7.

The pair of conveying rollers 21 is disposed in front of the transfer unit 5. The conveying rollers 21 are arranged parallel to and in contact with each other. More specifically, the conveying rollers 21 are juxtaposed with one of the conveying rollers 21 obliquely above and forward of the other of the conveying rollers 21.

The sheet supply tray 20 is disposed in a bottom portion of the main casing 2. The sheet supply tray 20 accommodates sheets of paper P as an example of a recording medium.

The scanning unit 3 is disposed in an upper portion of the main casing 2. As indicated by dashed lines in FIG. 1, the scanning unit 3 irradiates laser beams toward photosensitive drums 11 (described later) based on image data.

The process unit 4 is disposed below the scanning unit 3 and above the transfer unit 5. The process unit 4 is movable in the front-rear direction between a mounted position as an example of a first position and a withdrawn position as an example of a second position. In the mounted position, the process unit 4 is fixed in position inside the main casing 2. In the withdrawn position, the process unit 4 is withdrawn to outside of the main casing 2, as indicated in phantom in FIG. 1. The process unit 4 includes a drawer unit 9 as an example of a unit, and a plurality of developer cartridges 10.

The drawer unit 9 includes a plurality of (four in the embodiment) photosensitive drums 11, and a plurality of (four in the embodiment) scorotron chargers 12.

The plurality of photosensitive drums 11 is disposed at a bottom portion of the drawer unit 9. The plurality of photosensitive drums 11 is arranged juxtaposed with and parallel to one another, spaced apart from one another in the front-rear direction. The plurality of photosensitive drums 11 each has a cylindrical shape and is oriented with its axis in a left-right direction. The plurality of photosensitive drums 11 are provided for the colors black, yellow, magenta, and cyan.

The plurality of scorotron chargers 12 is disposed at positions corresponding to the plurality of photosensitive drums 11. Each scorotron charger 12 is positioned obliquely above and rearward of the corresponding photosensitive drum 11 with a gap therebetween.

The plurality of developer cartridges 10 is disposed at positions corresponding to the plurality of photosensitive drums 11. The plurality of developer cartridges 10 accommodates toner as an example of a developer in one of the colors black, yellow, magenta, and cyan. Each developer cartridge 10 is disposed above the corresponding photosensitive drum 11. Each developer cartridge 10 can be mounted in and removed from the drawer unit 9. Each of the plurality of developer cartridges 10 is provided with a developing roller 13.

The developing roller 13 is disposed in a lower end portion of the developer cartridge 10. The developing roller 13 contacts the corresponding photosensitive drum 11 from an upper front side thereof.

The transfer unit 5 is disposed below the process unit 4. The transfer unit 5 includes a drive roller 14, a follow roller 15, a conveying belt 16, and a plurality of (four in the embodiment) transfer rollers 17.

The drive roller 14 is disposed at a rear end of the transfer unit 5.

The follow roller 15 is disposed at a front end of the transfer unit 5.

The conveying belt 16 is formed in an endless belt. The conveying belt 16 is stretched around the drive roller 14 and the follow roller 15. The conveying belt 16 has an upper portion contacting the four photosensitive drums 11 at bottom sides thereof. When the drive roller 14 is driven to rotate, the conveying belt 16 circulates around the drive roller 14 and the follow roller 15 so that the follow roller 15 rotates to follow the circulating movement of the conveying belt 16. At this time, the upper portion of the conveying belt 16 moves rearward.

The plurality of transfer rollers 17 is provided at positions corresponding to the plurality of photosensitive drums 11. The plurality of transfer rollers 17 is disposed between the drive roller 14 and the follow roller 15 within the loop formed by the conveying belt 16. The plurality of transfer rollers 17 is disposed below the corresponding photosensitive drums 11 such that the upper portion of the conveying belt 16 is interposed therebetween.

The fixing unit 6 is disposed rearward of the transfer unit 5. The fixing unit 6 includes a heating roller 18, and a pressure roller 19 that confronts the heating roller 18.

When the printer 1 performs an image-forming operation, each of the scorotron chargers 12 applies a uniform charge to a surface of the corresponding photosensitive drum 11. Next, the scanning unit 3 exposes the surfaces of the photosensitive drums 11 based on prescribed image data, forming electrostatic latent images on the surfaces of the photosensitive drums 11.

The toner accommodated in each developer cartridge 10 is positively tribocharged before being supplied onto a surface of the developing roller 13. The developing roller 13 carries on its surface a thin layer of toner having a uniform thickness. The developing roller 13 supplies the toner to the electrostatic latent image formed on the corresponding photosensitive drum 11, thereby developing the electrostatic latent image into a toner image as an example of a developer image.

In the meantime, rollers (not shown) convey the sheets of paper P from the sheet supply tray 20 along a U-shaped path that curves first upward and then rearward, and supply the sheets P one at a time to a position of contact between the conveying rollers 21. The conveying rollers 21 convey the sheet P at a prescribed timing between the conveying belt 16 and the forwardmost photosensitive drum 11.

The conveying belt 16 conveys the sheet P rearward through positions between the photosensitive drums 11 and the corresponding transfer rollers 17. At this time, the toner images carried on the photosensitive drums 11 are transferred onto the sheet P.

Next, the sheet P passes through the fixing unit 6, at which time the heating roller 18 applies heat to the sheet P while the pressure roller 19 applies pressure to the sheet P, thermally fixing the toner image to the sheet P.

Thereafter, the sheet P is conveyed along a U-shaped path that curves first upward and then forward, and is discharged onto a top surface of the main casing 2.

2. Detailed Description of Drawer Unit

Figure 2:
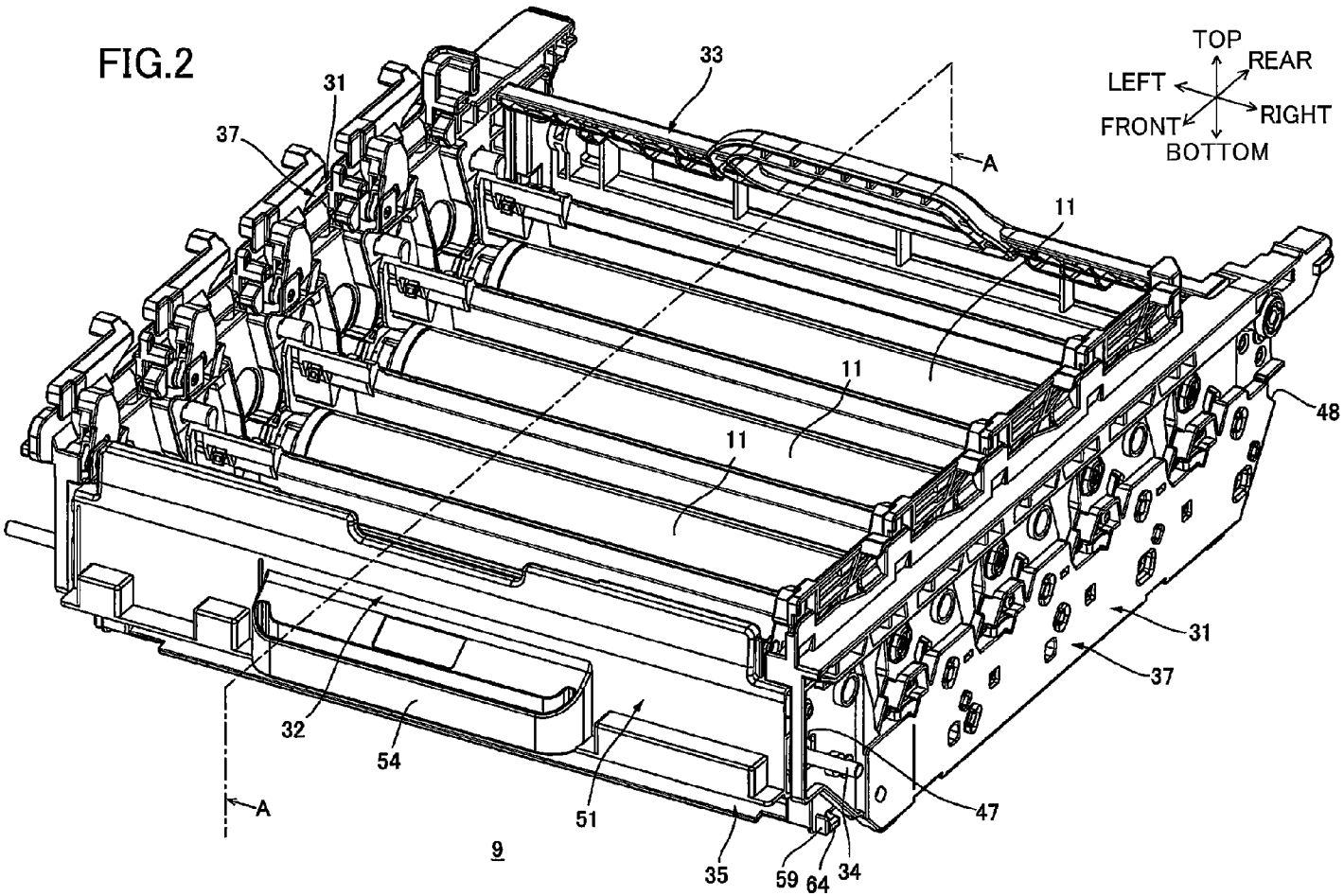
FIG. 2 is a perspective view of the drawer unit shown in FIG. 1 from an upper front side thereof.
Figure 3:
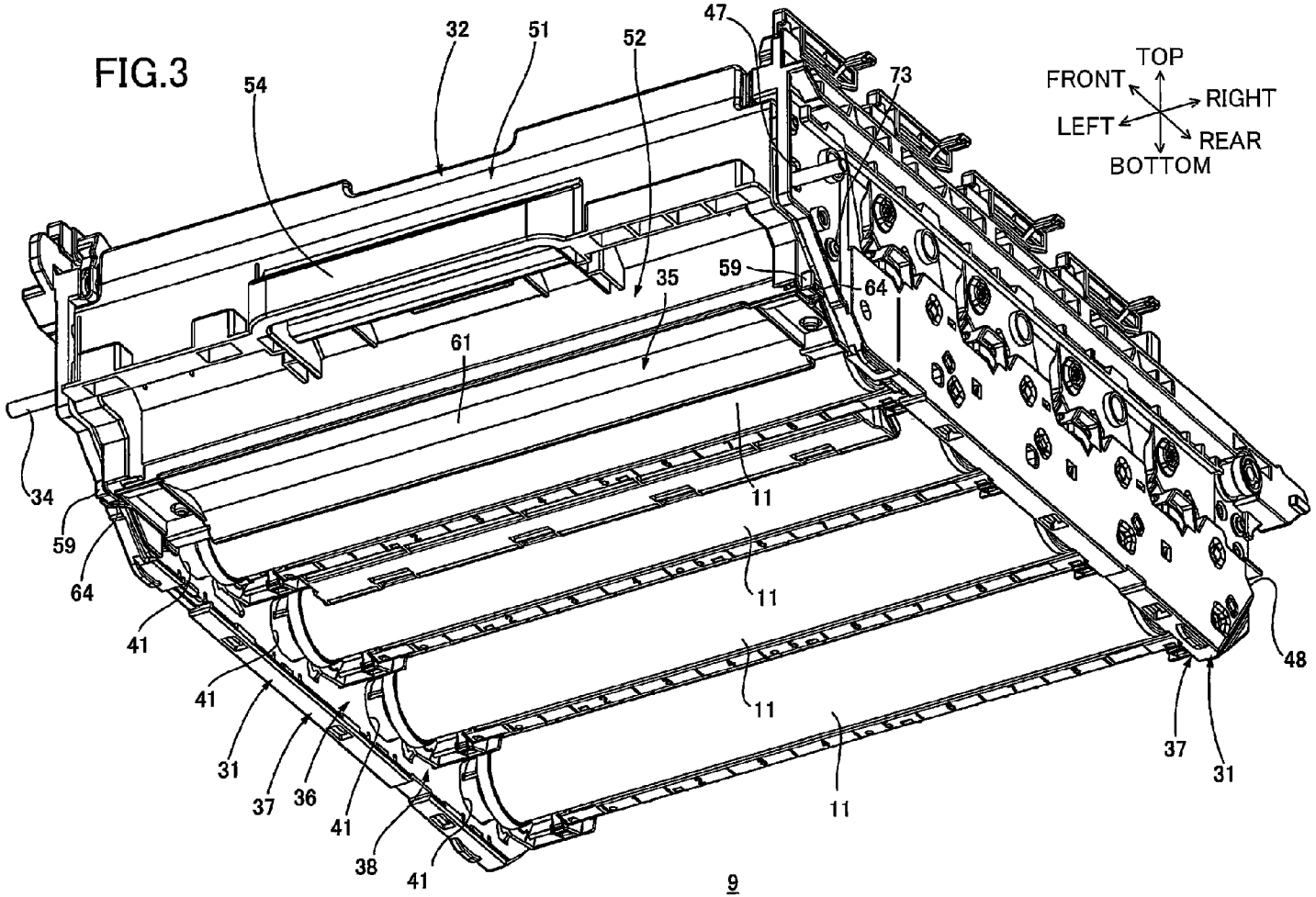
FIG. 3 is a perspective view of the drawer unit shown in FIG. 1 from a lower rear side thereof.

As shown in FIGS. 2 and 3, the drawer unit 9 has a frame-like structure that is generally rectangular in a plan view. The drawer unit 9 includes a pair of side plates 31, a front beam 32 as an example of a bridging member, a sheet guide 35 as an example of a guide member, a rear beam 33, and a positioning shaft 34 as an example of a positioning member. The side plates 31, the front beam 32, and the rear beam 33 constitute a frame.

(1) Side Plates

The side plates 31 are respectively disposed on left and right sides of the drawer unit 9. The side plates 31 have a general rectangular shape in a side view and are elongated in the front-rear direction. One of the side plates 31 is an example of a first side plate, while the other is an example of a second side plate. Each of the side plates 31 includes an inner plate 36, and an outer plate 37.

Figure 4:
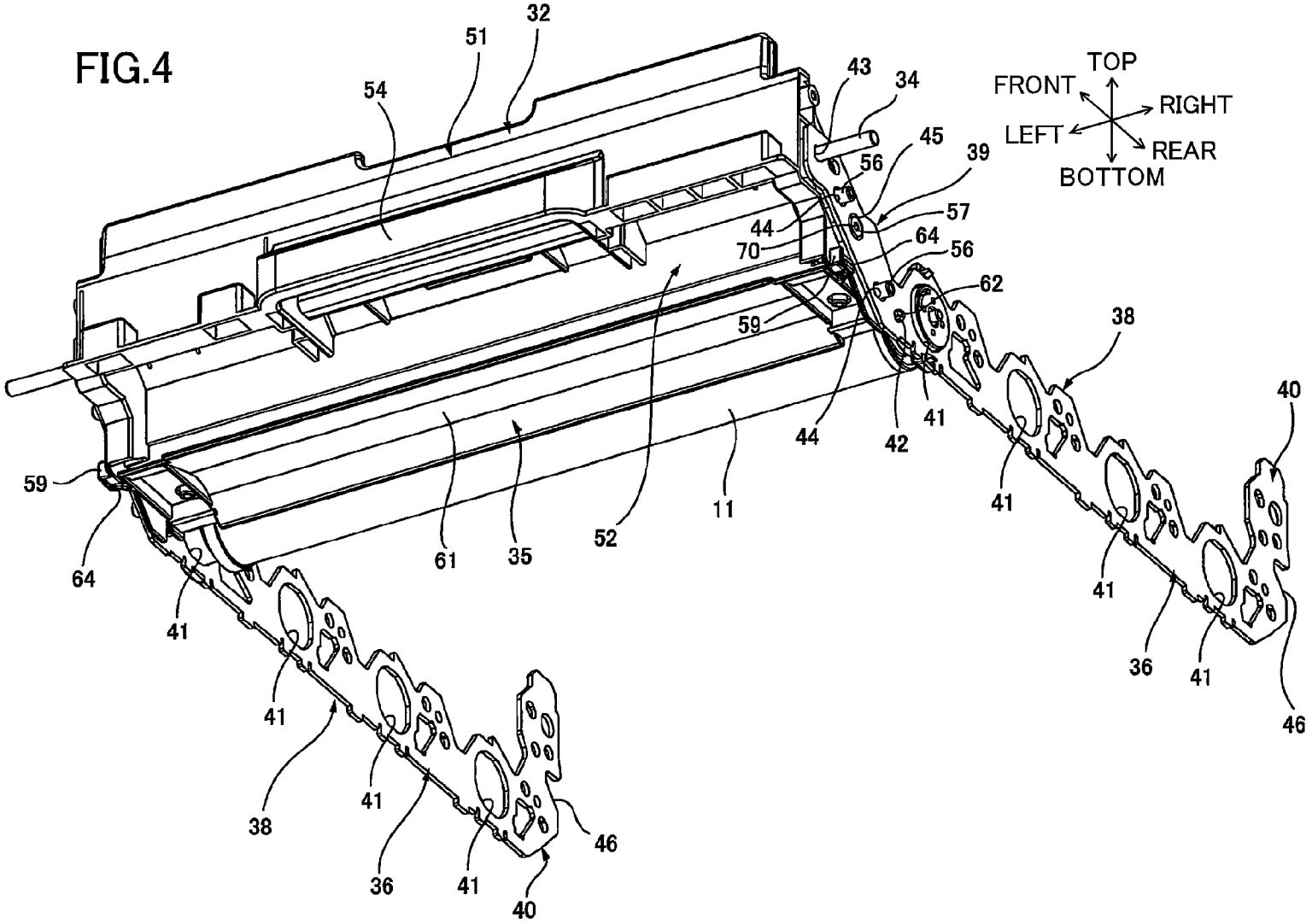
FIG. 4 is a perspective view illustrating how a front beam and a sheet guide shown in FIG. 3 are supported to inner plates.

As shown in FIG. 4, the inner plate 36 has a general rectangular shape in a side view and is elongated in the front-rear direction. The inner plate 36 is formed of metal, such as stainless steel or steel. The inner plates 36 of both the left and right side plates 31 are formed through a press-cutting process using the same punching die, and thus have the same shape. Each inner plate 36 includes a drum support portion 38, a front beam support portion 39, and a rear beam support portion 40.

The drum support portion 38 constitutes a front-rear center portion of the inner plate 36. The drum support portion 38 has a general rectangular shape in a side view and is elongated in the front-rear direction. The drum support portion 38 has a plurality of (four in the embodiment) drum support holes 41, and a guide support hole 42 as an example of a fitting hole.

The plurality of drum support holes 41 is arranged at intervals in the front-rear direction to correspond to the plurality of photosensitive drums 11. Each of the drum support holes 41 has a general circular shape in a side view. A left or right end of the corresponding photosensitive drum 11 is inserted through the drum support hole 41.

The guide support hole 42 is formed in the drum support portion 38 at a position forward of a bottom edge defining the forwardmost drum support hole 41. The guide support hole 42 has a general circular shape in a side view.

The front beam support portion 39 constitutes a front end portion of the inner plate 36. The front beam support portion 39 extends continuously from a front edge of the drum support portion 38 in a direction obliquely upward and forward. The front beam support portion 39 has a general rectangular shape in a side view. The front beam support portion 39 has a positioning shaft insertion hole 43, two support boss insertion holes 44, and a coupling boss insertion hole 45.

The positioning shaft insertion hole 43 is formed in an upper front end of the front beam support portion 39. The positioning shaft insertion hole 43 has a general rectangular shape in a side view.

One of the support boss insertion holes 44 is formed in an upper front end of the front beam support portion 39, while the other is formed in a lower rear end of the front beam support portion 39. The upper front support boss insertion hole 44 is positioned obliquely below and rearward of the positioning shaft insertion hole 43. The lower rear support boss insertion hole 44 is positioned obliquely above and forward of the guide support hole 42. The support boss insertion holes 44 are each an elongate hole that is elongated in the front-rear direction.

The coupling boss insertion hole 45 is formed in a vertical center region of the front beam support portion 39 at a position between the two support boss insertion holes 44. The coupling boss insertion hole 45 has a general circular shape in a side view.

The rear beam support portion 40 constitutes a rear end portion of the inner plate 36. The rear beam support portion 40 has a general rectangular shape in a side view and is elongated vertically. The rear beam support portion 40 extends continuously rearward from a rear edge of the drum support portion 38. The rear beam support portion 40 has a notch 46.

The notch 46 is formed in a rear edge of the rear beam support portion 40. The notch 46 has a general V-shape in a side view that is open on a rear side. When projected in the left-right direction, a peripheral edge of the rear beam support portion 40 defining the notch 46 are exposed in a notch 48 (described later) formed in the outer plate 37.

Figure 9:
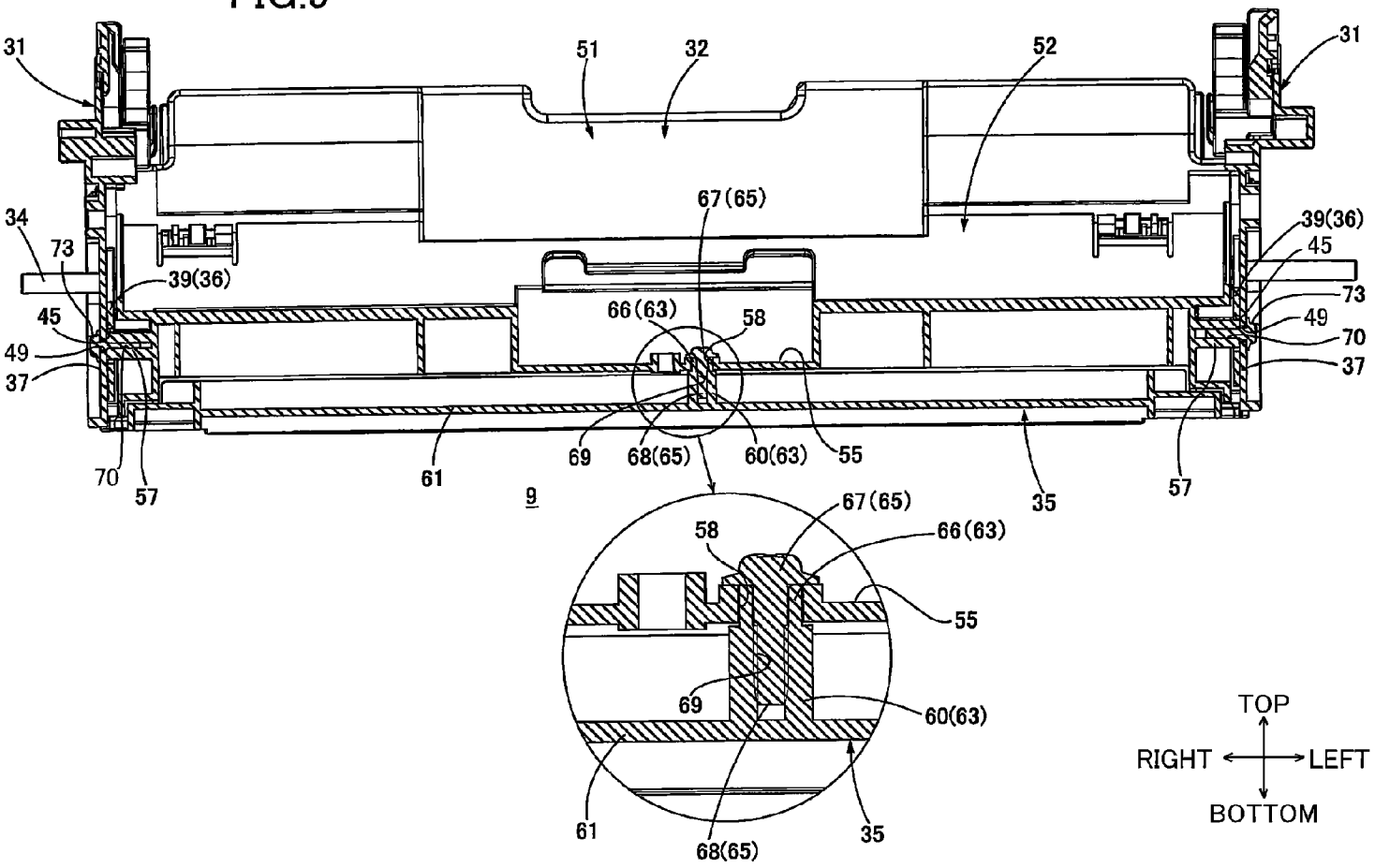
FIG. 9 is a cross-sectional view of the drawer unit shown in FIG. 8 taken along a line B-B.

As shown in FIGS. 3 and 9, the outer plate 37 is disposed on a left-right outer side of the corresponding inner plate 36. The outer plate 37 has a general rectangular shape in a side view. The outer plate 37 has a vertical dimension greater than that of the inner plate 36, while the outer plate 37 has a front-rear dimension substantially equal to that of the inner plate 36. The outer plate 37 is formed of a resin. The outer plate 37 has a positioning shaft insertion hole 47, the notch 48, and a screw insertion hole 49.

The positioning shaft insertion hole 47 is formed in a front end portion of the outer plate 37 at a position outside of the positioning shaft insertion hole 43 formed in the inner plate 36 and opposes the positioning shaft insertion hole 43 in the left-right direction. The positioning shaft insertion hole 47 has a general rectangular shape in a side view.

The notch 48 is formed in a rear edge of the outer plate 37 at a position outside of the notch 46 formed in the inner plate 36 and opposes the notch 46 in the left-right direction. The notch 48 has a general V-shape in a side view that is open on a rear side, and is formed larger than the notch 46 in the inner plate 36.

The screw insertion hole 49 is formed in the front end portion of the outer plate 37 at a position outside of the coupling boss insertion hole 45 formed in the inner plate 36 and opposes the coupling boss insertion hole 45 in the left-right direction. The screw insertion hole 49 has a general circular shape in a side view.

(2) Front Beam

Figure 5:
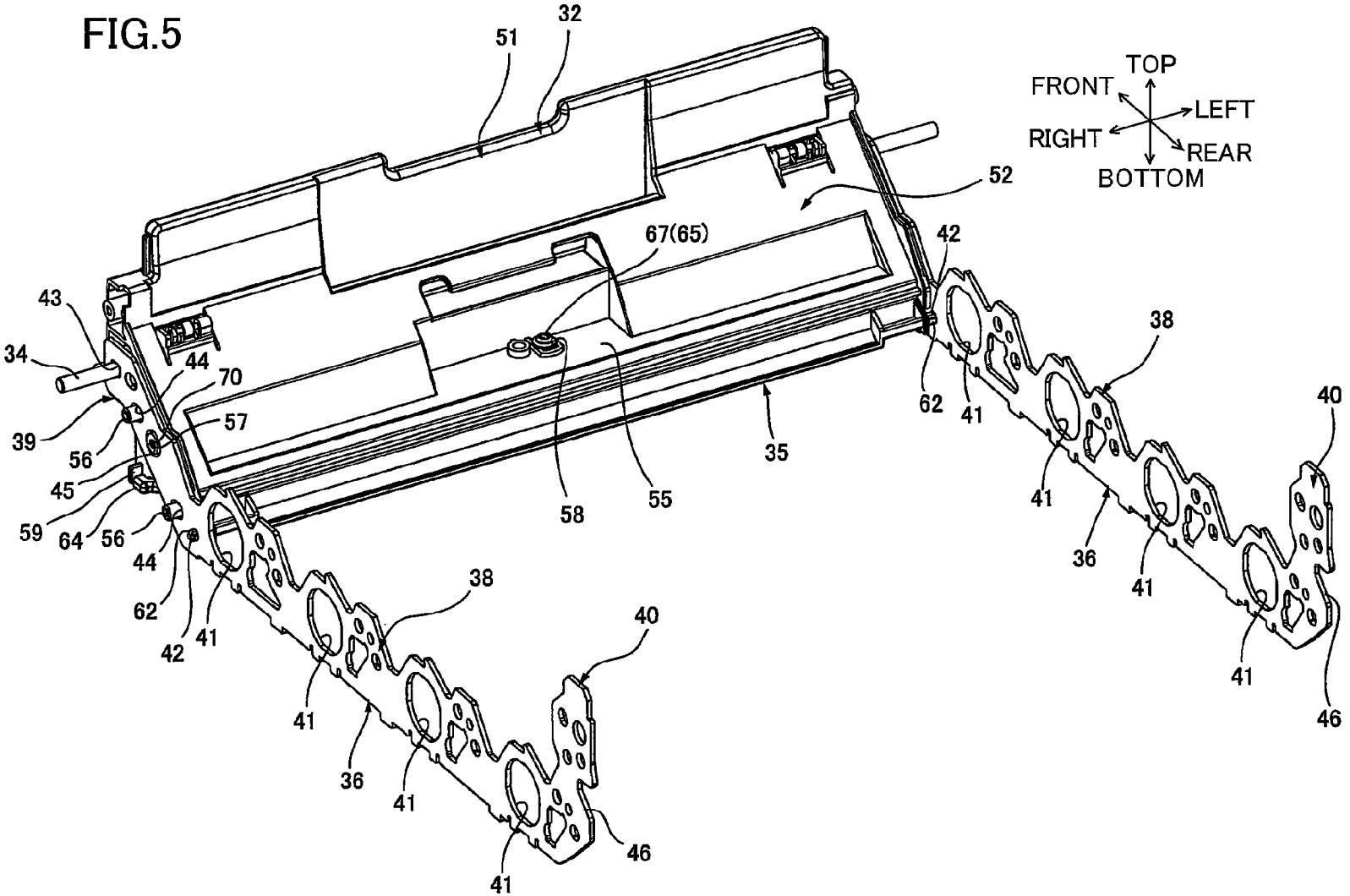
FIG. 5 is a perspective view illustrating how the front beam and the sheet guide shown in FIG. 3 are supported to the inner plates.

As shown in FIGS. 4 and 5, the front beam 32 is disposed between front end portions of the pair of side plates 31. The front beam 32 is formed of high-impact polystyrene (PS-HI). The front beam 32 includes a body portion 51, and a support potion 52.

Figure 6:
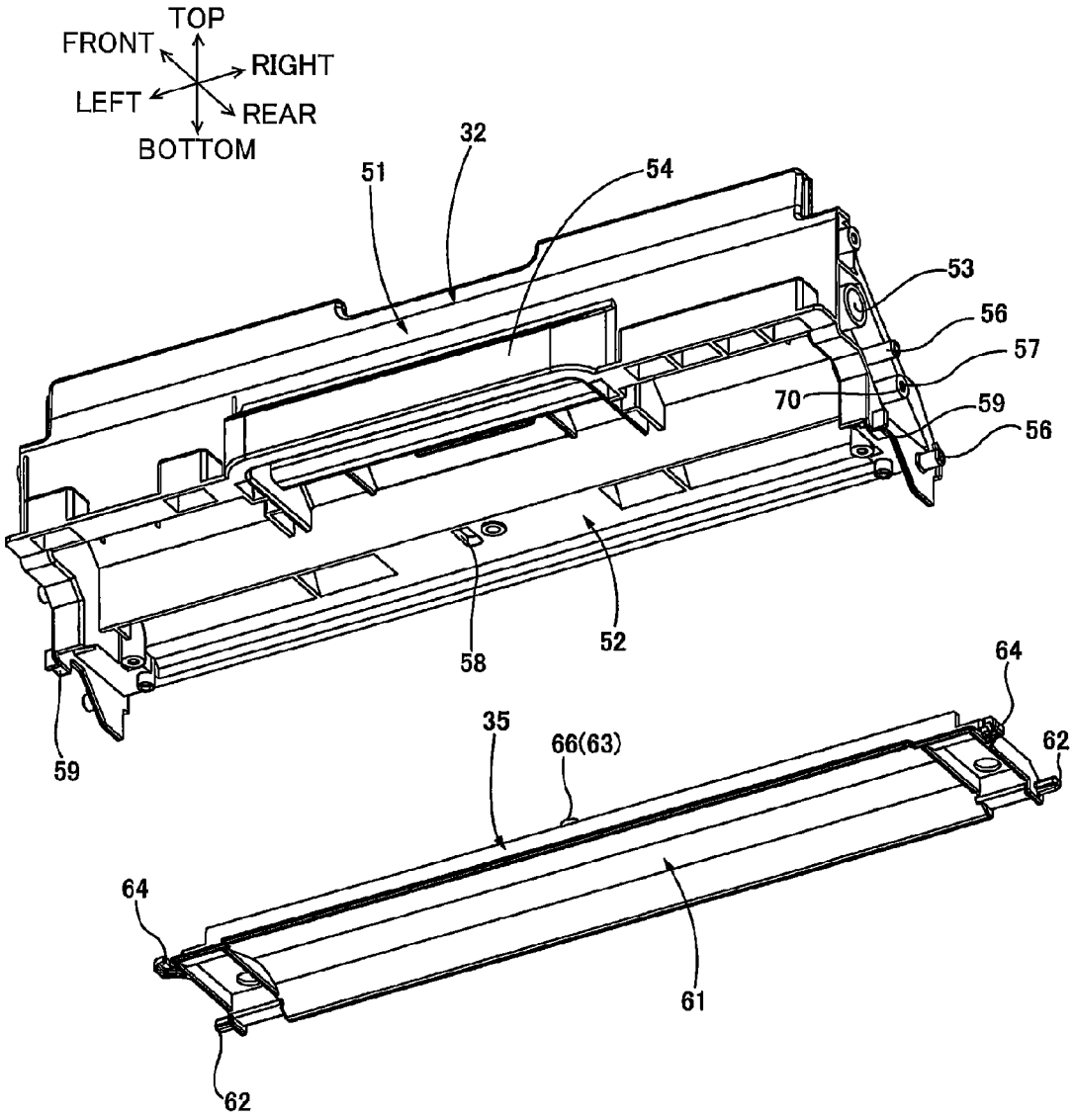
FIG. 6 is a perspective view showing the front beam and the sheet guide depicted in FIG. 4 from a lower front side thereof.

As shown in FIGS. 4 and 6, the body portion 51 has a plate shape that is rectangular in a front view and elongated in the left-right direction. The body portion 51 has a positioning shaft insertion hole 53, and a grip portion 54.

The positioning shaft insertion hole 53 is provided in an approximate vertical center region of the body portion 51, penetrating the body portion 51 in the left-right direction. The positioning shaft insertion hole 53 has a general circular shape in a side view.

The grip portion 54 is provided in a left-right center region of the body portion 51. The grip portion 54 has a general rectangular shape in a front view. The grip portion 54 is elongated in the left-right direction, and protrudes forward from a front surface of the body portion 51.

As shown in FIGS. 5 and 6, the support portion 52 has a generally triangular prism shape that is elongated in the left-right direction. The support portion 52 is formed continuously from a rear edge of the body portion 51, protruding rearward therefrom. The support portion 52 includes a recessed portion 55, a plurality of support bosses 56, a plurality of coupling bosses 57, and a plurality of engaging portions 59.

The recessed portion 55 is formed in a rear portion of the support portion 52 in a left-right center region thereof. The recessed portion 55 is recessed below a top surface of the support portion 52. The recessed portion 55 has a general rectangular shape in a plan view and is elongated in the left-right direction. The recessed portion 55 has a threaded portion insertion hole 58.

The threaded portion insertion hole 58 is formed in a left-right center region of the recessed portion 55. The threaded portion insertion hole 58 is an elongate hole that is elongated in the front-rear direction and penetrates the support potion 52 vertically.

Two of the support bosses 56 are provided on both left and right surfaces of the support portion 52, for a total of four support bosses 56. The two support bosses 56 provided on the right surface of the support portion 52 are arranged with one on an upper front end of the support portion 52 and one on a lower rear end of the support portion 52. While not shown in the drawings, the two support bosses 56 provided on the left surface of the support portion 52 are arranged so as to be aligned with the two support bosses 56 on the right surface of the support portion 52 when projected in the left-right direction.

The support bosses 56 have a general columnar shape and protrude outward in the left and right directions from the respective left and right surfaces of the support portion 52. The left and right support bosses 56 disposed on the upper front ends of the support portion 52 are fitted into the support boss insertion holes 44 formed in the upper front ends of the left and right inner plates 36, respectively. The left and right support bosses 56 disposed on the lower rear ends of the support portion 52 are fitted into the support boss insertion holes 44 formed in the lower rear ends of the left and right inner plates 36, respectively.

One of the coupling bosses 57 is provided in vertical center regions of both the left and right surfaces of the support portion 52, for a total of two coupling bosses 57. The coupling bosses 57 have a general columnar shape and protrude outward in the left and right directions from the respective left and right surfaces of the support portion 52. The left and right coupling bosses 57 are fitted into the coupling boss insertion holes 45 formed in the left and right inner plates 36, respectively. Each of the coupling bosses 57 has a threaded hole 70.

The threaded hole 70 is formed in a center region of the coupling boss 57. The threaded hole 70 is recessed into an outer left-right surface of the coupling boss 57. The threaded hole 70 has a general circular shape in a side view. As shown in FIG. 9, the threaded hole 70 is aligned with the screw insertion hole 49 formed in the outer plate 37. A screw 73 is fitted and screwed into the threaded hole 70 through the screw insertion hole 49, thereby fixing the front beam 32 to the outer plate 37.

As shown in FIG. 6, one of the engaging portions 59 is provided on a lower front corner of each of the left and right surfaces of the support portion 52, for a total of two engaging portions 59. The left and right engaging portions 59 protrude outward in the left and right directions from the respective left and right surfaces of the support portion 52. Each of the engaging portions 59 extends vertically and bends rearward from a bottom edge of the vertically extending portion. In other words, the engaging portions 59 have a general L-shape in a side view.

(3) Sheet Guide

Figure 7:
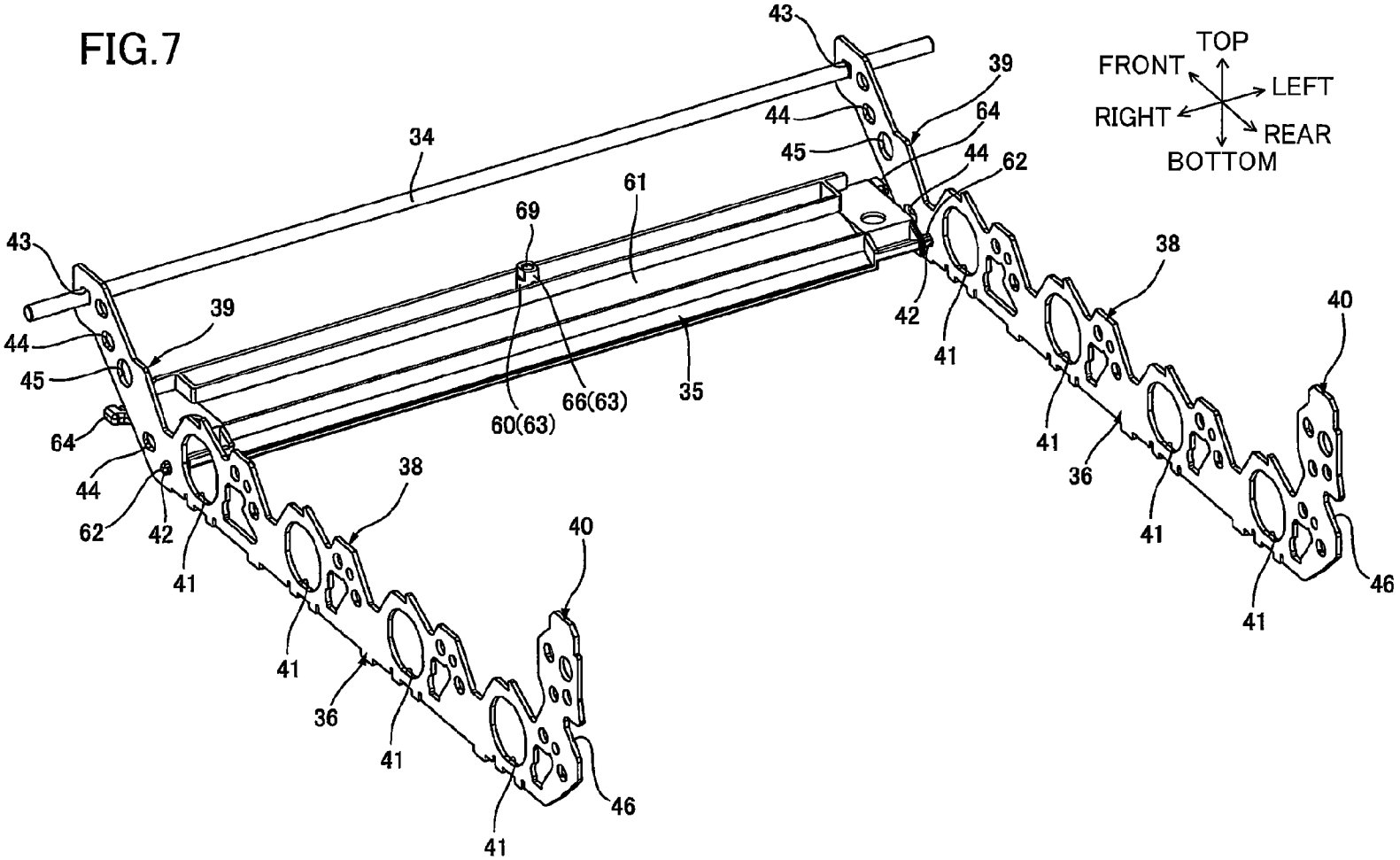
FIG. 7 is a perspective view illustrating how the sheet guide depicted in FIG. 5 is supported to the inner plates.

As shown in FIGS. 6 and 7, the sheet guide 35 has a general plate shape that is elongated in the left-right direction with its thickness in the vertical dimension.

The sheet guide 35 is formed of acrylonitrile-ethylene-styrene (AES) resin. The sheet guide 35 includes a guide portion 61, two guide support bosses 62 one as an example of a first positioned portion and the other as an example of a second positioned portion, a threaded portion 63 as an example of a supported portion, two engaging portions 64 as an example of a supported portion, and a screw 65 as an example of a coupling member.

Figure 8:
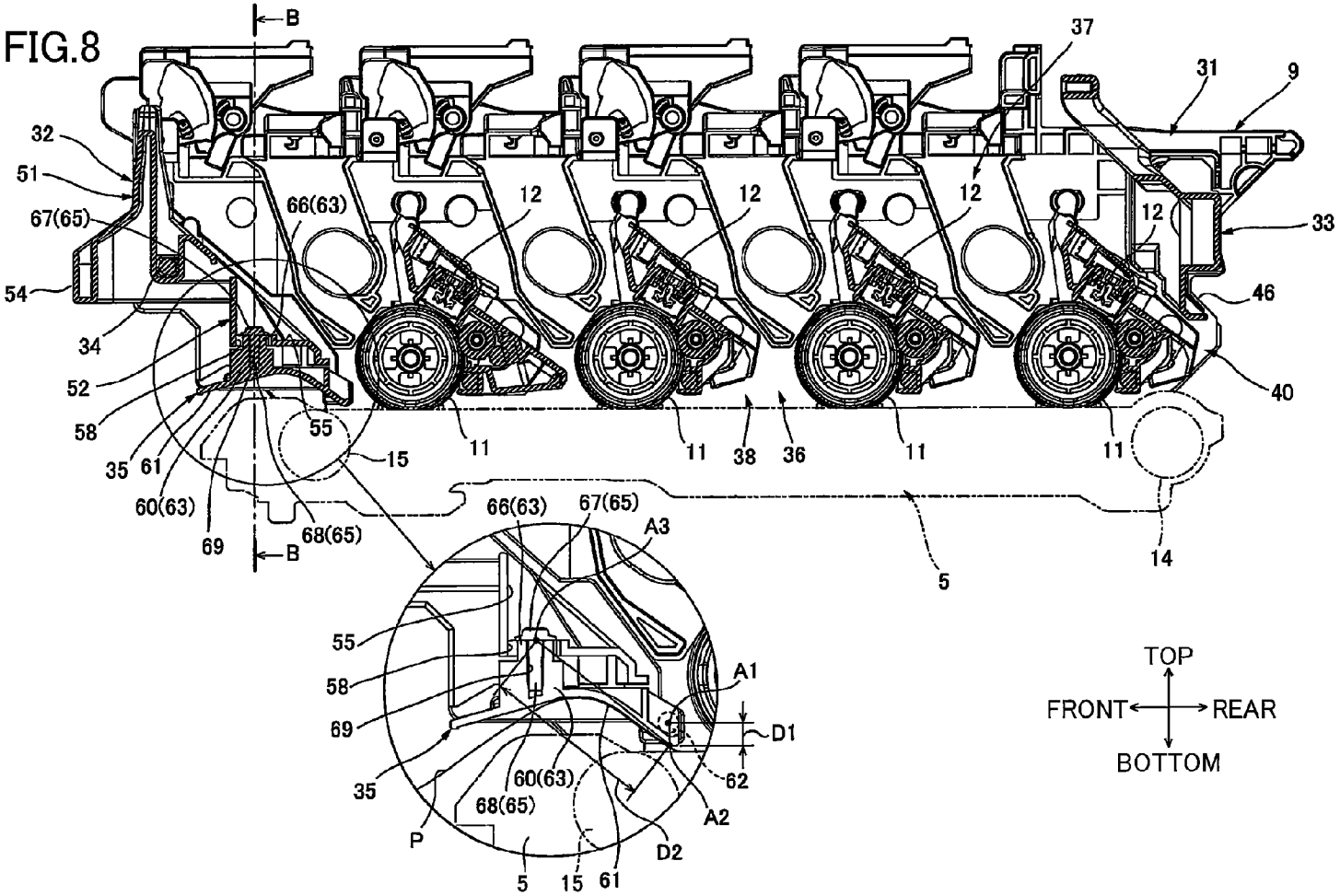
FIG. 8 is a cross-sectional view of the drawer unit shown in FIG. 2 taken along a line A-A.

As shown in FIGS. 6 and 8, the guide portion 61 constitutes an approximate left-right center region of the sheet guide 35. The guide portion 61 has a plate shape that is elongated in the left-right direction. The guide portion 61 has an approximate front-rear center region that protrudes upward in a convex shape. That is, beginning from its front edge, a bottom surface of the guide portion 61 begins to slope upward toward the rear, curves at the approximate front-rear center region in a direction sloping down toward the rear, and continues to slope further downward to its rear edge. A rear end of the guide portion 61 has a bottom edge A2 (see the enlarged view of FIG. 8).

In a state where the process unit 4 is in its mounted position, a front end of the guide portion 61 is positioned above and spaced apart from the front end of the transfer unit 5. Further, in a state where the process unit 4 is in its mounted position, a rear end of the guide portion 61 is positioned above and spaced apart from the conveying belt 16 over a rear portion of the follow roller 15.

As shown in FIGS. 6, 7, and 9, one of the two guide support bosses 62 is disposed on a rear end of each of left and right surfaces of the sheet guide 35 so as to be positioned at a rear end of the guide portion 61 when projected in the left-right direction. The guide support bosses 62 protrude outward in the left and right directions from the respective left and right surfaces of the sheet guide 35. The guide support bosses 62 have a cross-like columnar shape in a side view with its axial center A1 (see the enlarged view of FIG. 8) aligned in the left-right direction. The guide support bosses 62 have front-rear and vertical dimensions substantially equivalent to an inner diameter of the guide support holes 42 formed in the left and right inner plates 36. The left and right guide support bosses 62 are fitted into the guide support holes 42 of the left and right inner plates 36, respectively.

The threaded portion 63 is provided on a rear end of the sheet guide 35 in a left-right center region thereof. The threaded portion 63 has a body portion 60, an insertion portion 66, and a threaded hole 69.

The body portion 60 constitutes a bottom half of the threaded portion 63. The body portion 60 has a general cylindrical shape and extends upward from a top surface of the sheet guide 35. The body portion 60 is disposed at a position below and slightly separated from the support portion 52 of the front beam 32. When a front end of the sheet guide 35 pivotally moves upward about the guide support bosses 62, the body portion 60 contacts a peripheral edge (as an example of a contact portion) of the threaded portion insertion hole 58 formed in the front beam 32. This contact restricts the sheet guide 35 from pivotally moving further upward.

The insertion portion 66 constitutes an upper half of the threaded portion 63. The insertion portion 66 has a general oval shape in a plan view that is elongated in the front-rear direction. The insertion portion 66 protrudes upward from a top surface of the body portion 60. The insertion portion 66 has a left-right dimension substantially equivalent to a left-right dimension of the threaded portion insertion hole 58, as shown in FIG. 9. The insertion portion 66 has a front-rear dimension shorter than a front-rear dimension of the threaded portion insertion hole 58, as shown in FIG. 8. The insertion portion 66 has a vertical dimension greater than a vertical dimension of the threaded portion insertion hole 58. The insertion portion 66 is fitted into the threaded portion insertion hole 58.

The threaded hole 69 is formed approximately in the center of the threaded portion 63. The threaded hole 69 extends vertically through the insertion portion 66 and the body portion 60 of the threaded portion 63 entirely. The threaded hole 69 has a general circular shape in a plan view. The threaded hole 69 has a front-rear center A3 at its top end (see the enlarged view of FIG. 8).

As shown in FIGS. 6 and 7, one of the two engaging portions 64 is disposed on a front end of each of the left and right surfaces of the sheet guide 35. The engaging portions 64 protrude outward in the left and right directions from the respective left and right surfaces of the sheet guide 35. Each of the engaging portions 64 extends in the left-right direction, then bends downward at an outer left-right end thereof to form a general L-shape in a front view. The left and right engaging portions 64 are disposed above and separated slightly from the left and right engaging portions 59 of the front beam 32, respectively. When the front end of the sheet guide 35 is bent downward by an external force applied thereto, the left and right engaging portions 64 respectively engage with the left and right engaging portions 59 (as an example of a contact portion) of the front beam 32 from above. This engagement restricts the sheet guide 35 from bending further.

As shown in FIG. 9, the screw 65 is integrally formed of a head portion 67, and a shaft 68.

The head portion 67 constitutes a top portion of the screw 65. The head portion 67 has a generally circular plate shape with its thickness in the vertical dimension. The head portion 67 has an outer diameter larger than a left-right dimension of the threaded portion insertion hole 58. The head portion 67 is placed in confrontation with left and right peripheral edges of the threaded portion insertion hole 58. That is, the head portion 67 is seated upon the left and right peripheral edges of the threaded portion insertion hole 58.

The shaft 68 has a general columnar shape and extends downward from the bottom of the head portion 67. The shaft 68 is formed coaxially with the head portion 67. The shaft 68 is screwed into the threaded hole 69 of the threaded portion 63. That is, in a state where the shaft 68 is screwed into the threaded hole 69, a front-rear center of the shaft 68 at its top end is coincident with the front-rear center A3 at the top end of the threaded hole 69.

With this configuration, in a state where the insertion portion 66 is fitted into the threaded portion insertion hole 58 while the screw 65 is screwed into the threaded hole 69, and the guide support bosses 62 are fitted into the respective guide support holes 42, the sheet guide 35 is supported to the front beam 32 at the threaded portion 63 and also supported to the inner plates 36 at the guide support bosses 62 while the sheet guide 35 is pivotally movable about the guide support bosses 62.

As shown in the enlarged view of FIG. 8, the axial center A1 of the guide support bosses 62 and the bottom edge A2 at the rear end of the guide portion 61 defines a distance D1 therebetween. Further, the bottom edge A2 at the rear end of the guide portion 61 and the front-rear center A3 at the top end of the threaded hole 69 (more specifically, the bottom edge A2 at the rear end of the guide portion 61 and the front-rear center at the top end of the shaft 68) defines a distance D2 therebetween. The distance D1 is shorter than the distance D2 when viewed in the left-right direction.

The bottom edge A2 at the rear end of the guide portion 61 is the lowest edge formed on the sheet guide 35.

(4) Rear Beam and Positioning Shaft

As shown in FIG. 2, the rear beam 33 has a general plate shape that is elongated in the left-right direction. The rear beam 33 is disposed between rear end portions of the pair of side plates 31.

The positioning shaft 34 is inserted through the positioning shaft insertion holes 43 formed in the left and right inner plates 36, the positioning shaft insertion holes 47 formed in the left and right outer plates 37, and the positioning shaft insertion hole 53 formed in the front beam 32 at a front end portion of the drawer unit 9. The positioning shaft 34 has a general rod shape and is oriented in the left-right direction. Left and right ends of the positioning shaft 34 protrude outward in the left and right directions from outer left-right surfaces of the respective outer plates 37.

3. Detailed Description of Main Casing

As shown in FIG. 1, a main casing reference shaft 71 and positioning shaft support portions 72 are provided in the main casing 2.

The main casing reference shaft 71 is disposed in a rear portion of the main casing 2. The main casing reference shaft 71 has a general rod shape and is oriented in the left-right direction so as to bridge left and right side walls of the main casing 2. The main casing reference shaft 71 is fitted into the notches 46 formed in the left and right inner plates 36 when the process unit 4 is placed in the mounted position. Thus, the main casing reference shaft 71 positions front ends of the respective inner plates 36 in the main casing 2.

One of the positioning shaft support portions 72 is provided on each of the left and right side walls of the main casing 2. Top surfaces of the positioning shaft support portions 72 position the positioning shaft 34 when the process unit 4 is placed in the mounted position.

4. Operations of Sheet Guide

As shown in the enlarged view of FIG. 8, when the conveying rollers 21 convey the sheet P between the forwardmost photosensitive drum 11 and the conveying belt 16 in the image-forming operation described above, a leading edge of the sheet P, that is, a downstream edge of the sheet P in a sheet conveying direction, enters a space between the front end of the sheet guide 35 and the front end of the transfer unit 5, and contacts the sheet guide 35 from a bottom side thereof at the approximate front-rear center region of the guide portion 61.

As the sheet P is conveyed farther, the leading edge of the sheet P follows the curve of the guide portion 61 and is redirected to a direction sloping downward and rearward. The leading edge of the sheet P continues to advance along a downward slope toward the rear.

While advancing in this direction, the leading edge of the sheet P separates from the bottom edge A2 of the rear end of the guide portion 61 at a position above the rear portion of the follow roller 15. The leading edge of the sheet P continues to move diagonally downward and rearward away from the bottom edge A2 until contacting the upper portion of the conveying belt 16 from above.

Subsequently, the movement of the conveying belt 16 conveys the leading edge of the sheet P between the forwardmost photosensitive drum 11 and the conveying belt 16.

In this way, the sheet guide 35 guides the leading edge of the sheet P to be supplied between the forwardmost photosensitive drum 11 and the conveying belt 16.

5. Operational Advantages (1) In the drawer unit 9 according to the embodiment described above, the rear end of the sheet guide 35 is supported to the inner plates 36 at the guide support bosses 62, as shown in FIGS. 5 and 8, while the front end of the sheet guide 35 is supported to the front beam 32 at the threaded portion 63.

With this configuration, the bottom edge A2 of the rear end of the sheet guide 35 is unlikely to be affected by manufacturing variation, linear expansion, and the like in the front beam 32.

Moreover, the distance D1 between the axial center A1 of the guide support bosses 62 and the bottom edge A2 at the rear end of the sheet guide 35 is shorter than the distance D2 between the bottom edge A2 at the rear end of the sheet guide 35 and the front-rear center A3 at the top end of the threaded hole 69 formed in the threaded portion 63, more specifically, the front-rear center at the top end of the shaft 68 constituting the screw 65, when viewed in the left-right direction. In other words, the guide support bosses 62 are positioned near the bottom edge A2 of the rear end of the sheet guide 35.

Accordingly, the bottom edge A2 at the rear end of the sheet guide 35 can be precisely supported relative to the inner plates 36.

Thus, through a simple construction, the sheet guide 35 can reliably guide the sheets P toward the conveying belt 16 along a straight path that follows the circulating movement of the conveying belt 16 with no vertical or left-right skew, irrespective of any manufacturing variation or linear expansion in the front beam 32.

(2) In the drawer unit 9 according to the embodiment described above, the pair of inner plates 36 supports the photosensitive drums 11, as shown in FIG. 4. Hence, the pair of inner plates 36 supports both the sheet guide 35 and the photosensitive drums 11.

This construction can position the bottom edge A2 of the rear end of the sheet guide 35 more accurately relative to the photosensitive drums 11.

Thus, the sheets P can be guided accurately to the photosensitive drums 11.

(3) In the drawer unit 9 according to the embodiment described above, the two guide support bosses 62 are fitted into the corresponding guide support holes 42 formed in the left and right inner plates 36, as shown in FIG. 5.

Accordingly, the left and right inner plates 36 can support the rear end of the sheet guide 35 through a simple structure.

(4) In the drawer unit 9 according to the embodiment described above, the pair of inner plates 36 shown in FIG. 4 are formed of metal.

Accordingly, the metal inner plates 36 can support the bottom edge A2 of the rear end of the sheet guide 35 with greater precision.

Thus, the sheet guide 35 can more reliably guide the sheets P.

(5) In the drawer unit 9 according to the embodiment described above, the front beam 32 is formed of a resin, and specifically, high-impact polystyrene, and is disposed between the pair of inner plates 36, as shown in FIG. 4.

Forming the front beam 32 of resin in this way can reduce the weight of the drawer unit 9.

(6) In the drawer unit 9 according to the embodiment described above, the sheet guide 35 is formed of AES resin, and the front beam 32 is formed of high-impact polystyrene.

Forming the sheet guide 35 of the highly-abrasion resistant AES resin enables the sheet guide 35 to be supported to the pair of inner plates 36 with greater precision.

Consequently, the sheet guide 35 can guide the sheets P more reliably.

(7) In the drawer unit 9 according to the embodiment described above, the threaded portion 63 is disposed in the left-right center region of the sheet guide 35, as shown in FIG. 5.

Accordingly, the sheet guide 35 can be supported to the front beam 32 through a simple construction.

(8) In the drawer unit 9 according to the embodiment described above, the sheet guide 35 is supported to the front beam 32 so that a gap can be formed between the body portion 60 of the threaded portion 63 and the front beam 32, as shown in FIG. 9.

With this construction, the effects of manufacturing variation or linear expansion in the front beam 32 and the like can be absorbed by the gap between the body portion 60 of the threaded portion 63 and the front beam 32.

Consequently, the sheet guide 35 can guide the sheets P more reliably.

(9) In the drawer unit 9 according to the embodiment described above, the engaging portions 64 are provided on both of the left and right ends of the sheet guide 35, as shown in FIG. 4. When the front end of the sheet guide 35 is bent downward by an external force, the two engaging portions 64 engage with the corresponding engaging portions 59 of the front beam 32.

This engagement restrains the front end of the sheet guide 35 from bending excessively downward due to an external force applied thereto.

Consequently, the sheet guide 35 can be reliably supported to the front beam 32 across its entire left-right dimension.

(10) In the drawer unit 9 according to the embodiment described above, the body portion 60 of the threaded portion 63 is disposed below the threaded portion insertion hole 58 formed in the front beam 32 and confronts the peripheral edge of the threaded portion insertion hole 58. Further, the two engaging portions 64 confront the two engaging portions 59 of the front beam 32 from above, respectively.

Thus, when the front end of the sheet guide 35 pivotally moves upward about the guide support bosses 62, the body portion 60 of the threaded portion 63 contacts the peripheral edge of the threaded portion insertion hole 58. This contact restricts the sheet guide 35 from pivotally moving farther upward.

Further, when the front end of the sheet guide 35 pivotally moves downward about the guide support bosses 62, the engaging portions 64 contact the corresponding engaging portions 59 of the front beam 32. This contact restricts further downward pivotal movement of the sheet guide 35.

In this way, the threaded portion 63 and the engaging portions 64 limit the pivotal movement of the sheet guide 35 about the guide support bosses 62.

Restricting pivotal movement of the sheet guide 35 in this way enables the sheet guide 35 to guide the sheets P reliably.

(11) The drawer unit 9 according to the embodiment described above can be moved between a mounted position inside the main casing 2 and a withdrawn position outside of the main casing 2, as shown in FIG. 1.

This construction facilitates maintenance of the drawer unit 9 by enabling the drawer unit 9 to be positioned outside the main casing 2, as shown in phantom in FIG. 1.

(12) In the drawer unit 9 according to the embodiment described above, the pair of inner plates 36 supports the positioning shaft 34, which is fixed in position relative to the main casing 2 when the drawer unit 9 is in the mounted position.

Hence, the pair of inner plates 36 supports both the positioning shaft 34 fixed in position relative to the main casing 2, and the sheet guide 35.

With this configuration, the sheet guide 35 can be positioned relative to the main casing 2 through the positioning shaft 34.

Accordingly, the sheet guide 35 can be supported to the drawer unit 9, which is capable of moving relative to the main casing 2, and can be positioned in the main casing 2 with precision when the drawer unit 9 is placed in the mounted position.

Thus, this construction enables the sheet guide 35 to guide the sheet P reliably, while facilitating maintenance of the drawer unit 9.

6. Modifications

Various modifications are conceivable. In the following description, only parts differing from those of the embodiment will be described in detail.

(1) First Modification

Figure 10A:
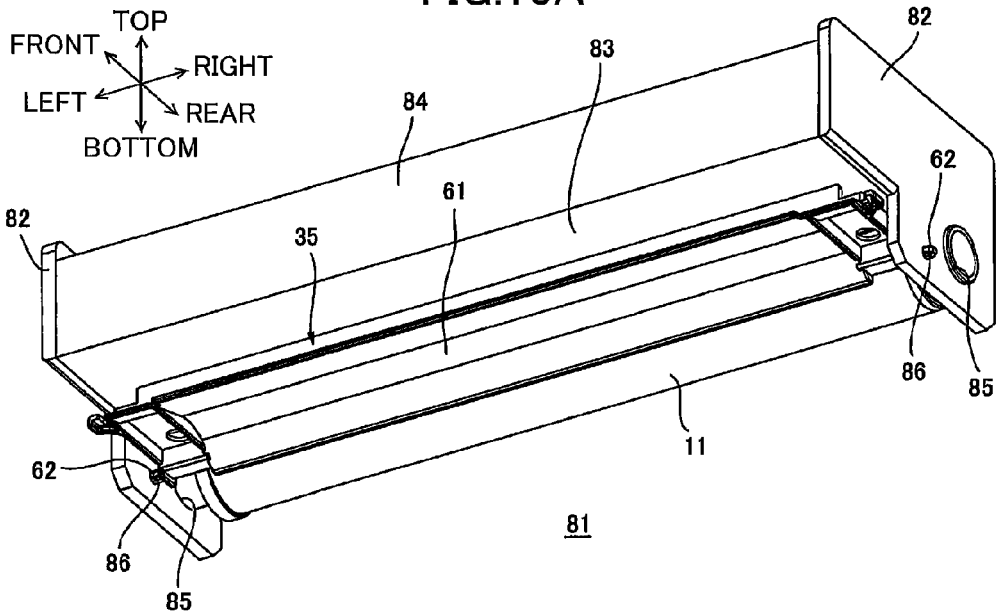
FIG. 10A is a perspective view of a drawer unit according to a first modification of the embodiment from a lower front side thereof.
Figure 10B:
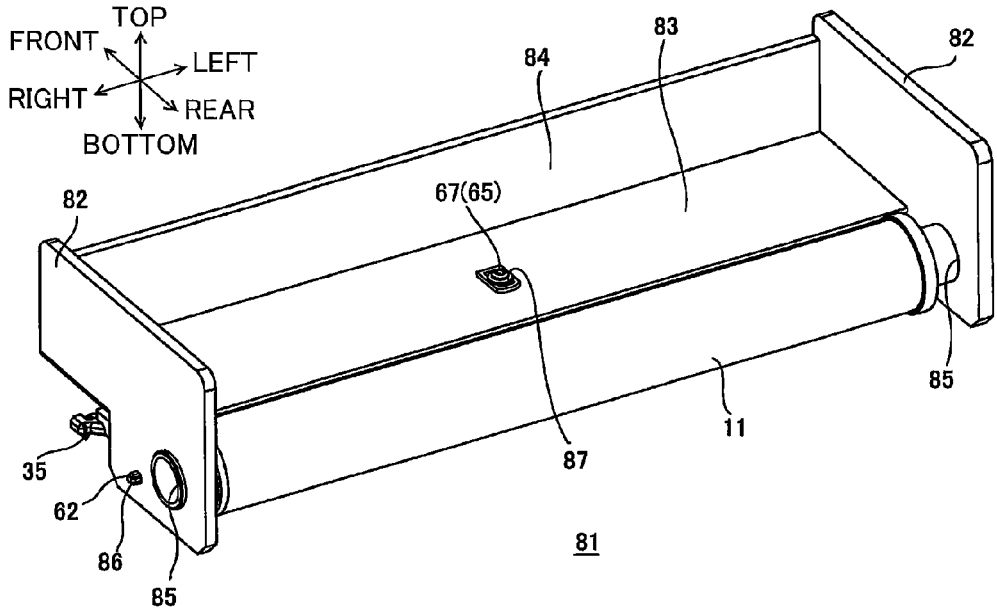
FIG. 10B is a perspective view of the drawer unit shown in FIG. 10A from an upper rear side thereof.

In the embodiment described above, the drawer unit 9 includes the plurality of photosensitive drums 11. However, a drum unit 81 as an example of a unit includes a single photosensitive drum 11, as shown in FIGS. 10A and 10B.

The drum unit 81 includes a pair of side plates 82, a bottom plate 83 as an example of a bridging member, and a front plate 84. One of the side plates 82 is an example of a first side plate, while the other is an example of a second side plate.

The side plates 82 are arranged on left and right ends of the drum unit 81, respectively. The side plates 82 have a plate shape that is generally rectangular in a side view and elongated vertically. Each side plate 82 has a drum support hole 85, and a guide support hole 86.

The drum support hole 85 is formed in the lower rear portion of the side plate 82 and has a general circular shape in a side view. The left and right ends of the photosensitive drum 11 are inserted through the corresponding drum support holes 85 formed in the left and right side plates 82.

The guide support hole 86 is formed in the side plate 82 at a position forward from a bottom edge of the drum support hole 85. The guide support hole 86 has a general circular shape in a side view.

The bottom plate 83 bridges the pair of side plates 82 at a position forward of the photosensitive drum 11. The bottom plate 83 has a plate shape that is generally rectangular in a plan view and elongated in the front-rear direction. The bottom plate 83 has a threaded portion insertion hole 87.

The threaded portion insertion hole 87 is formed in a left-right center portion of the bottom plate 83. The threaded portion insertion hole 87 is an elongate hole that is elongated in the front-rear direction and penetrates the bottom plate 83 vertically.

The front plate 84 is arranged on a front end of the drum unit 81 and bridges the pair of side plates 82. The front plate 84 has a plate shape that is generally rectangular in a front view and elongated vertically and in the left-right direction. The front plate 84 has a bottom edge that is formed continuously with a front edge of the bottom plate 83.

As in the embodiment described above, the sheet guide 35 is supported to the drum unit 81. Specifically, the guide support bosses 62 of the sheet guide 35 are respectively fitted into the guide support holes 86 formed in the left and right side plates 82. The insertion portion 66 of the threaded portion 63 of the sheet guide 35 is fitted into the threaded portion insertion hole 87 formed in the bottom plate 83. Further, the shaft 68 of the screw 65 is screwed into the threaded hole 69 of the threaded portion 63 such that the head portion 67 of the screw 65 confronts the left and right peripheral edges of the threaded portion insertion hole 87.

The drum unit 81 according to the first modification described above can obtain the same operational advantages as the drawer unit 9 in the embodiment.

(2) Second Modification

In the embodiment described above, the threaded portion 63 is provided in the left-right center portion of the sheet guide 35. However, there are no particularly restrictions on the positioning and number of threaded portions 63. For example, the threaded portions 63 may be provided in both left and right ends of the sheet guide 35.

This configuration allows the sheet guide 35 to be supported to the front beam 32 with greater stability across the left-right dimension of the sheet guide 35.

Alternatively, the threaded portions 63 may be provided on both the left and right ends of the sheet guide 35 in addition to the threaded portion 63 in the left-right center portion of the sheet guide 35, for example.

While the present invention has been described in detail with reference to the embodiment thereof, it would be apparent to those skilled in the art that various changes and modifications may be made therein without departing from the spirit of the present invention.

What is claimed is:

1. A unit for an image forming apparatus comprising:

a frame comprising:

a first side plate;

a second side plate disposed spaced apart from the first side plate in a first direction; and a bridging member bridging the first side plate and the second side plate;

a photosensitive drum supported to the first side plate and the second side plate; and a guide member bridging the first side plate and the second side plate and configured to guide a recording medium in a second direction perpendicular to the first direction, the guide member comprising:

a first positioned portion configured to be fixed in position relative to the first side plate;

a second positioned portion configured to be fixed in position relative to the second side plate;

a first end in the second direction;

a second end opposite to the first end in the second direction, the first end being closer relative to the photosensitive drum than the second end; and a supported portion supported to the bridging member, the first end and one of the first positioned portion and the second positioned portion defining a first distance therebetween, and the first end and the supported portion defining a second distance therebetween, the first distance being smaller than the second distance.

2. The unit as claimed in claim 1, wherein the guide member has a first end portion facing the first side plate, and a second end portion opposite to the first end portion in the first direction and facing the second side plate;

wherein the first positioned portion is a boss protruding in the first direction toward the first side plate from the first end portion, and the second positioned portion is a boss protruding in the first direction toward the second side plate from the second end portion; and wherein the first side plate has a first fitting hole in which the first positioned portion is fitted, and the second side plate has a second fitting hole in which the second positioned portion is fitted.

3. The unit as claimed in claim 1, wherein the first side plate and the second side plate are each made of metal.

4. The unit as claimed in claim 1, wherein the bridging member is made of resin.

5. The unit as claimed in claim 4, wherein the guide member is made of a material different from a material of the bridging member.

6. The unit as claimed in claim 4, wherein the guide member has a center portion in the first direction, the supported portion being disposed at the center portion.

7. The unit as claimed in claim 6, further comprising a coupling member configured to couple the guide member with the frame such that the supported portion and the bridging member are spaced apart from each other.

8. The unit as claimed in claim 1, wherein the guide member has a first end portion and a second end portion opposite to the first end portion in the first direction; and wherein the supported portion is provided at the first end portion and the second end portion of the guide member.

9. The unit as claimed in claim 1, wherein the guide member is configured to be pivotally movable about the first positioned portion and the second positioned portion; and wherein the supported portion is configured to restrict the pivotal movement of the guide member.

10. The unit as claimed in claim 1, wherein the unit in its entirety is configured to move between a first position in which the unit is positioned inside a main casing of the image forming apparatus and a second position in which the unit is positioned outside the main casing of the image forming apparatus.

11. The unit as claimed in claim 10, further comprising a positioning member configured to be fixed in position relative to the main casing of the image forming apparatus in a state where the unit is at the first position, the first side plate and the second side plate being configured to support the positioning member.

12. The unit as claimed in claim 9, wherein the bridging member includes a contact portion; and wherein the supported portion being configured to contact the contact portion to restrict the guide member from pivotally moving about the first positioned portion and the second positioned portion.

* * * * *